US009731170B2

(12) United States Patent
Franklin et al.

(10) Patent No.: US 9,731,170 B2
(45) Date of Patent: Aug. 15, 2017

(54) GOLF CLUBS AND GOLF CLUB HEADS

(71) Applicant: Nike, Inc., Beaverton, OR (US)

(72) Inventors: David N. Franklin, Granbury, TX (US); Jason Cardani, Portland, OR (US); Andrew G. V. Oldknow, Beaverton, OR (US); Raymond J. Sander, Benbrook, TX (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 14/290,422

(22) Filed: May 29, 2014

(65) Prior Publication Data

US 2015/0343276 A1 Dec. 3, 2015

(51) Int. Cl.

| | |
|---|---|
| ***A63B 53/04*** | (2015.01) |
| ***A63B 53/02*** | (2015.01) |
| ***A63B 60/52*** | (2015.01) |
| ***A63B 60/54*** | (2015.01) |
| *A63B 60/50* | (2015.01) |

(52) U.S. Cl.

CPC ..... *A63B 53/02* (2013.01); *A63B 53/047* (2013.01); *A63B 60/52* (2015.10); *A63B 60/54* (2015.10); *A63B 60/50* (2015.10); *A63B 2053/042* (2013.01); *A63B 2053/0416* (2013.01); *A63B 2053/0479* (2013.01); *A63B 2053/0491* (2013.01)

(58) Field of Classification Search

CPC ... A63B 53/0475; A63B 53/047; A63B 53/02; A63B 60/52; A63B 60/54; A63B 2053/0479; A63B 2053/0416; A63B 60/50; A63B 2053/042; A63B 2053/0491

See application file for complete search history.

(56) References Cited

U.S. PATENT DOCUMENTS

| | | | | |
|---|---|---|---|---|
| 1,968,626 A * | 7/1934 | Young | A63B 53/04 473/329 |
| 4,534,558 A * | 8/1985 | Yoneyama | A63B 53/04 273/DIG. 23 |
| 4,582,321 A * | 4/1986 | Yoneyama | A63B 53/04 473/348 |

(Continued)

FOREIGN PATENT DOCUMENTS

GB 2281040 A 2/1995

OTHER PUBLICATIONS

Oct. 28, 2015—(WO) International Search Report and Written Opinion—PCT/US2015/032956.

*Primary Examiner* — Stephen Blau

(57) ABSTRACT

Golf club heads include a golf club head body, a ball striking face, and a shaft engaging member configured to engage a golf club shaft with the golf club head body. The golf club head may be configured with a first piece and a second piece, which may be in the form of the shaft engaging member and a body member connected to the shaft engaging member. The shaft engaging member includes a base member and an arm extending from the base member, and the body member includes a face having a striking surface configured for striking a ball and a club head body positioned behind the face, the second piece having a receiving slot positioned behind the face, where the base member of the first piece is at least partially received within the receiving slot.

38 Claims, 14 Drawing Sheets

(56) References Cited

U.S. PATENT DOCUMENTS 4,630,827 A * 12/1986 Yoneyama ..... A63B 53/04 473/348
4,635,941 A * 1/1987 Yoneyama ..... A63B 53/04 273/DIG. 23
4,664,383 A * 5/1987 Aizawa ..... A63B 53/02 273/DIG. 7
4,667,963 A * 5/1987 Yoneyama ..... A63B 53/04 473/348
4,697,814 A * 10/1987 Yamada ..... A63B 53/04 473/348
4,699,383 A * 10/1987 Kobayashi ..... A63B 53/04 473/348
4,708,347 A * 11/1987 Kobayashi ..... A63B 53/04 473/338
4,754,975 A * 7/1988 Aizawa ..... A63B 53/04 473/348
4,798,384 A * 1/1989 Kobayashi ..... A63B 53/04 473/349
4,811,950 A * 3/1989 Kobayashi ..... A63B 53/04 473/335
5,004,242 A * 4/1991 Iwanaga ..... A63B 53/04 273/DIG. 23
5,009,425 A * 4/1991 Okumoto ..... A63B 53/04 273/DIG. 12
5,078,397 A * 1/1992 Aizawa ..... A63B 53/04 273/DIG. 23
5,226,659 A * 7/1993 Lo ..... A63B 53/04 273/DIG. 23
5,228,694 A * 7/1993 Okumoto ..... A63B 53/04 473/348
5,333,871 A * 8/1994 Wishon ..... A63B 53/04 273/DIG. 23
5,505,450 A * 4/1996 Stuff ..... A63B 53/04 473/329
5,509,660 A * 4/1996 Elmer ..... A63B 53/04 473/288
5,586,947 A * 12/1996 Hutin ..... A63B 53/04 473/324
6,443,857 B1 * 9/2002 Chuang ..... A63B 53/04 473/332
6,616,546 B2 * 9/2003 Cho ..... A63B 53/04 473/329
6,971,961 B2 * 12/2005 Chen ..... A63B 53/04 473/342
7,371,188 B2 * 5/2008 Chen ..... A63B 53/047 473/329
7,390,270 B2 * 6/2008 Roberts ..... A63B 53/047 473/332
7,524,250 B2 * 4/2009 Soracco ..... A63B 53/047 473/349
7,815,519 B2 * 10/2010 Bryant ..... A63B 53/0487 473/288
7,892,106 B2 * 2/2011 Matsunaga ..... A63B 53/047 473/290
8,939,848 B2 * 1/2015 Soracco ..... A63B 53/0475 473/329
2002/0082113 A1 * 6/2002 Su ..... A63B 53/04 473/332
2014/0038747 A1 2/2014 Dolezel et al.
2015/0057101 A1 * 2/2015 Sander ..... A63B 53/0466 473/342

* cited by examiner

GOLF CLUBS AND GOLF CLUB HEADS

FIELD OF THE DISCLOSURE

The present disclosure relates to golf clubs and golf club heads. Particular example aspects of this disclosure relate to the configuration of golf club heads.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well-known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.). Still other advancements have sought to provide golf club constructions that provide improved feel to the golfer or enhanced energy transfer from the golf club to the golf ball.

While the industry has witnessed dramatic changes and improvements to golf equipment in recent years, there is room in the art for further advances in golf club technology. The present invention seeks to address certain of the shortcomings of prior golf club designs and to provide a design having advantages to heretofore provided.

BRIEF SUMMARY

The following presents a general summary of aspects of the disclosure in order to provide a basic understanding of the disclosure and various aspects of it. This summary is not intended to limit the scope of the disclosure in any way, but it simply provides a general overview and context for the more detailed description that follows.

Aspects of this disclosure relate to ball striking devices, such as iron-type golf club heads and iron-type golf clubs. Iron-type golf club heads according to at least some example aspects of this disclosure include: a golf club head body, a ball striking face, and a shaft engaging member which is configured to engage the golf club head body with a golf club shaft. According to aspects of the disclosure, the golf club head body and the shaft engaging member may be configured so as to engage with each other. Further, according to aspects of the disclosure, the golf club head may be configured with a first piece and a second piece, which may be in the form of the shaft engaging member and a body member connected to the shaft engaging member. The shaft engaging member includes a base member and an arm extending from the base member, and the body member includes a face having a striking surface configured for striking a ball and a club head body positioned behind the face, the second piece having a receiving slot positioned behind the face, where the base member of the first piece is at least partially received within the receiving slot.

According to aspects of this disclosure, the iron-type golf club head body and the shaft engaging member may be integrally formed and/or separate parts configured to engage with each other. Additionally, according to aspects of the disclosure, the iron-type golf club head body and the shaft engaging member may be configured to provide a connection between the iron-type golf club head body and the shaft engaging member, wherein the connection extends around at least a portion of the periphery of the iron-type golf club head body. Further, according to aspects of the disclosure, a shaft engaging member may be configured for connection to multiple different iron type golf club head bodies, and such bodies may be removable and interchangeable.

Further, it is noted that, according to aspects of the disclosure, the iron-type golf club head body and the shaft engaging member may be separate pieces configured to engage with each other. Additionally, according to other aspects of the disclosure, the iron-type golf club head body and the shaft engaging member may be integrally formed as a unitary, one-piece construction.

Other aspects of this disclosure may relate to wood-type golf club heads, putter heads, or other types of golf club heads. Such other types of golf club heads may include any features described herein with respect to iron-type club heads.

Additional aspects of this disclosure relate to golf club structures, including iron-type, wood-type, putter-type, and other golf club structures that include golf club heads, e.g., of the types described above. Such golf club structures further may include one or more of: a shaft attached to the club head (optionally via a separate shaft engaging member or a shaft engaging member provided as an integral part of one or more of the club head or shaft); a grip or handle attached to the shaft engaging member; additional weight members; etc.

Still additional aspects of this disclosure relate to methods for producing golf clubs and/or golf club heads in accordance with examples of this disclosure. Such methods may include, for example, one or more of the following steps in any desired order and/or combinations: (a) providing a golf club head, e.g., of the various types described above (including any or all of the various structures, features, and/or arrangements described above), e.g., by manufacturing or otherwise constructing the golf club head body, by obtaining it from a third party source, etc.; (b) engaging a shaft with the golf club head (e.g., via the shaft engaging member); and (c) engaging a grip with the shaft.

Still additional aspects of this disclosure relate to methods for producing golf club heads and golf club structures, e.g., of the types described above. Such methods may include, for example: (a) providing a golf club head of the various types described above, e.g., by manufacturing or otherwise constructing the golf club head, by obtaining the golf club head from another source, etc.; and (b) engaging the shaft with the golf club head (e.g., via the shaft connecting member). Other steps also may be included in these methods, such as engaging the shaft engaging member with the body member, engaging a grip with the shaft, club head body finishing steps, etc.

Given the general description of various example aspects of the disclosure provided above, more detailed descriptions of various specific examples of golf clubs and golf club head structures according to the disclosure are provided below.

BRIEF DESCRIPTION OF THE DRAWINGS

The present disclosure is illustrated by way of example and not limited in the accompanying figures, in which like reference numerals indicate similar elements throughout, and in which.

The reader is advised that the various parts shown in these drawings are not necessarily drawn to scale.

DETAILED DESCRIPTION

The following description and the accompanying figures disclose features of golf club heads and golf clubs in accordance with examples of the present disclosure.

The following discussion and accompanying figures describe various example golf clubs and golf club head structures in accordance with the present disclosure. When the same reference number appears in more than one drawing, that reference number is used consistently in this specification and the drawings to refer to the same or similar parts throughout.

More specific examples and features of iron-type golf club heads and golf club structures according to this disclosure will be described in detail below in conjunction with the example golf club structures illustrated in FIGS. 1-11.

Figure 1:
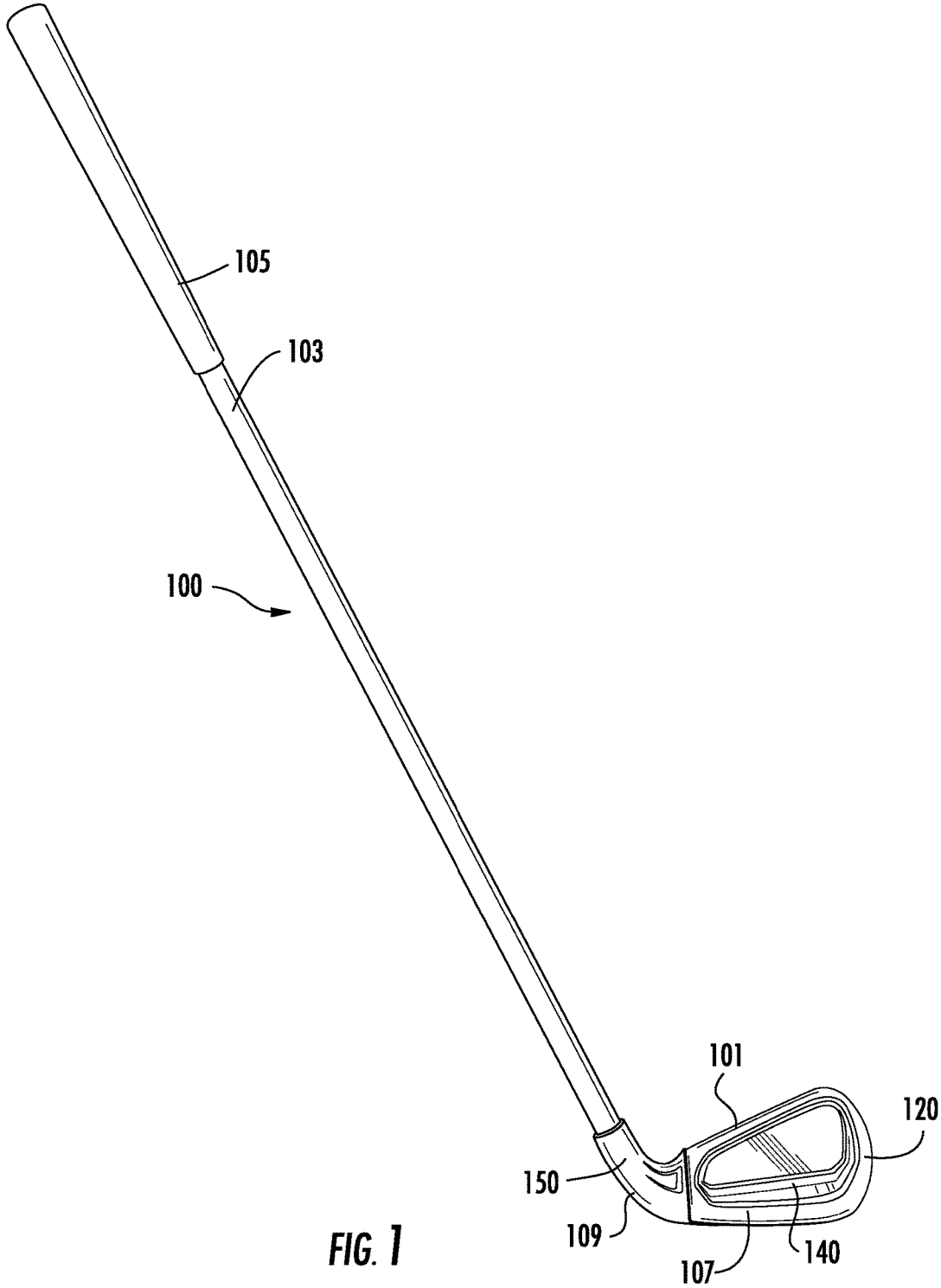
FIG. 1 is a rear view of an illustrative embodiment of an iron-type golf club according to aspects of the disclosure.

FIG. 1 generally illustrates an example of an iron-type golf club 100 according to aspects of the disclosure. As seen in FIG. 1, the iron-type golf club may include an iron-type golf club head 101 in accordance with the present disclosure.

In addition to the golf club head 101, the overall golf club structure 100 may include a shaft 103 and a grip or handle 105 attached to the shaft 103. The shaft 103 may be received in, engaged with, and/or attached to the golf club head 101, for example, through a shaft-receiving sleeve or element extending into the club head 101 (e.g., the shaft engaging member 109 discussed below), via a hosel (e.g., a hosel included in the shaft engaging member discussed below), and/or in other manners as will be described in more detail below. The connections may be via adhesives, cements, welding, soldering, mechanical connectors (such as threads, retaining elements, or the like), etc. If desired, the shaft 103 may be connected to the golf club head 101 in a releasable and/or adjustable manner using mechanical connectors to allow easy interchange of one shaft for another on the head and/or adjustment of the shaft with respect to the head.

The shaft 103 may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle 105 may be attached to, engaged with, and/or extend from the shaft 103 in any suitable or desired manner, including in conventional manners known and used in the art, e.g., using adhesives or cements, mechanical connectors, etc. As another example, if desired, the grip or handle 105 may be integrally formed as a unitary, one-piece construction with the shaft 103. Additionally, any desired grip or handle materials may be used without departing from this disclosure, including, for example: rubber materials, leather materials, rubber or other materials including cord or other fabric material embedded therein, polymeric materials, and the like.

Figure 1A:
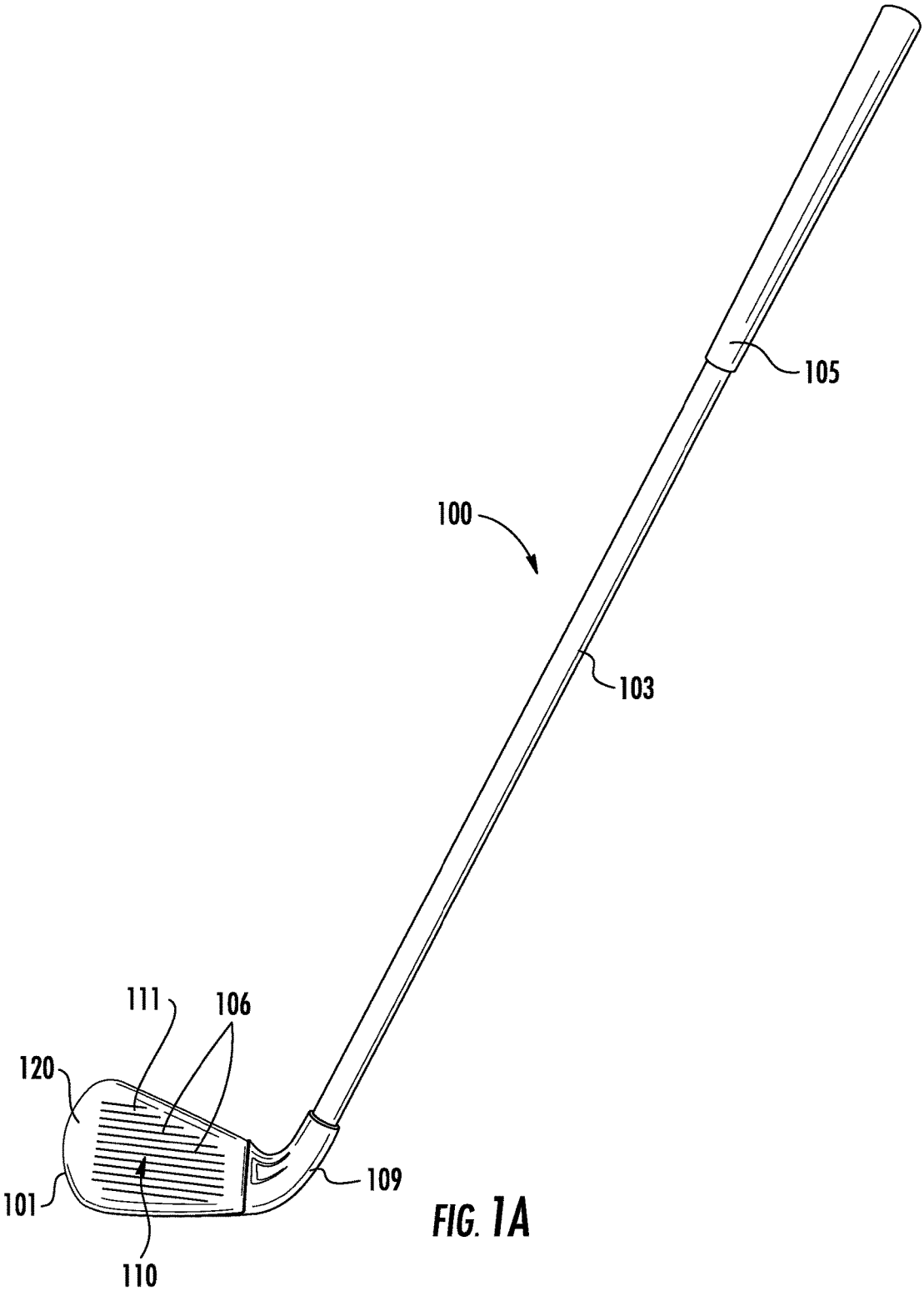
FIG. 1A is a front view of the head of the iron-type golf club shown in FIG. 1.
Figures 2A, 2B:
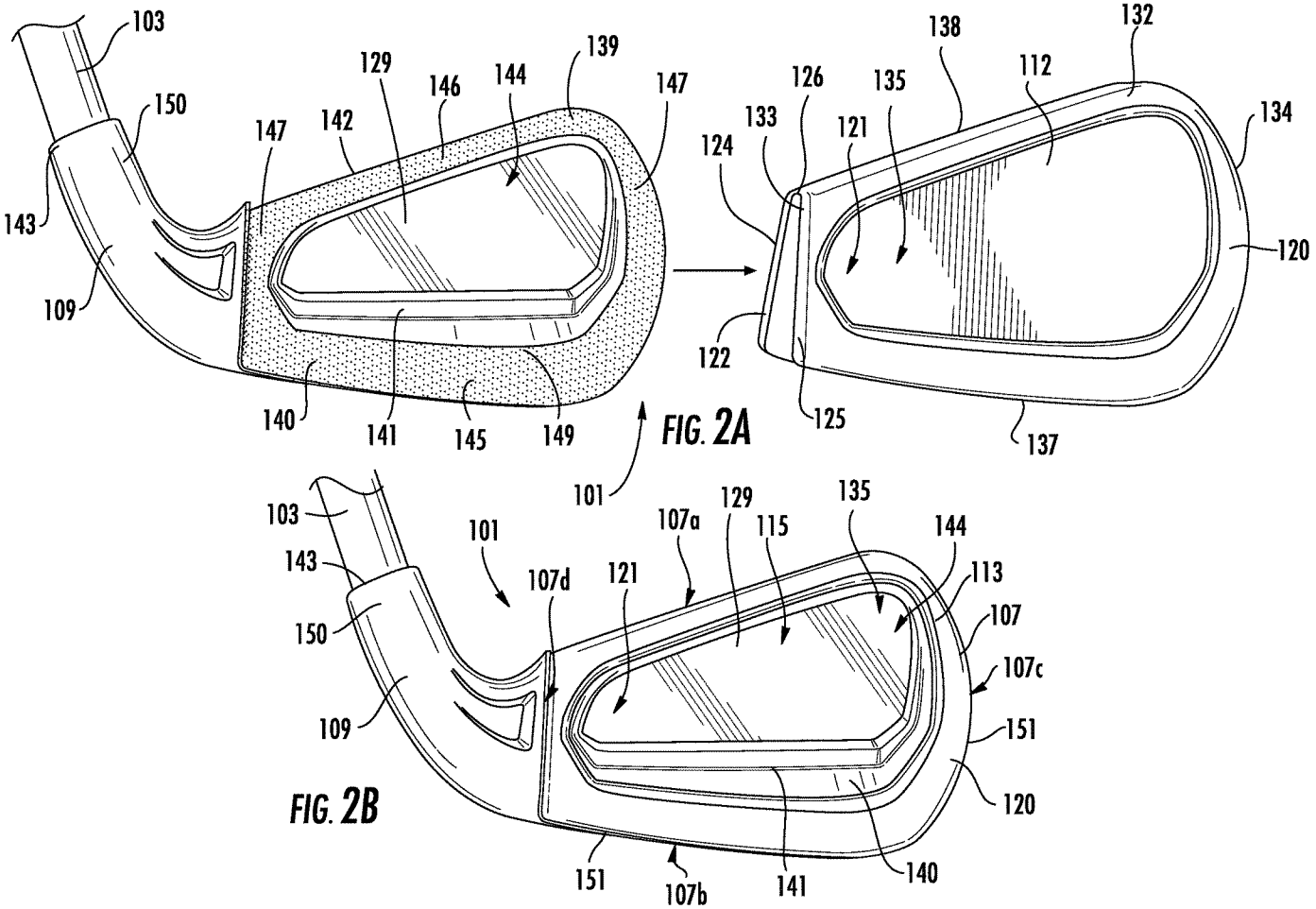
FIG. 2A is a partially exploded rear view of a head of the iron-type golf club shown in FIG. 1.
FIG. 2B is a rear view of the head of the iron-type golf club shown in FIG. 1.
Figure 3:
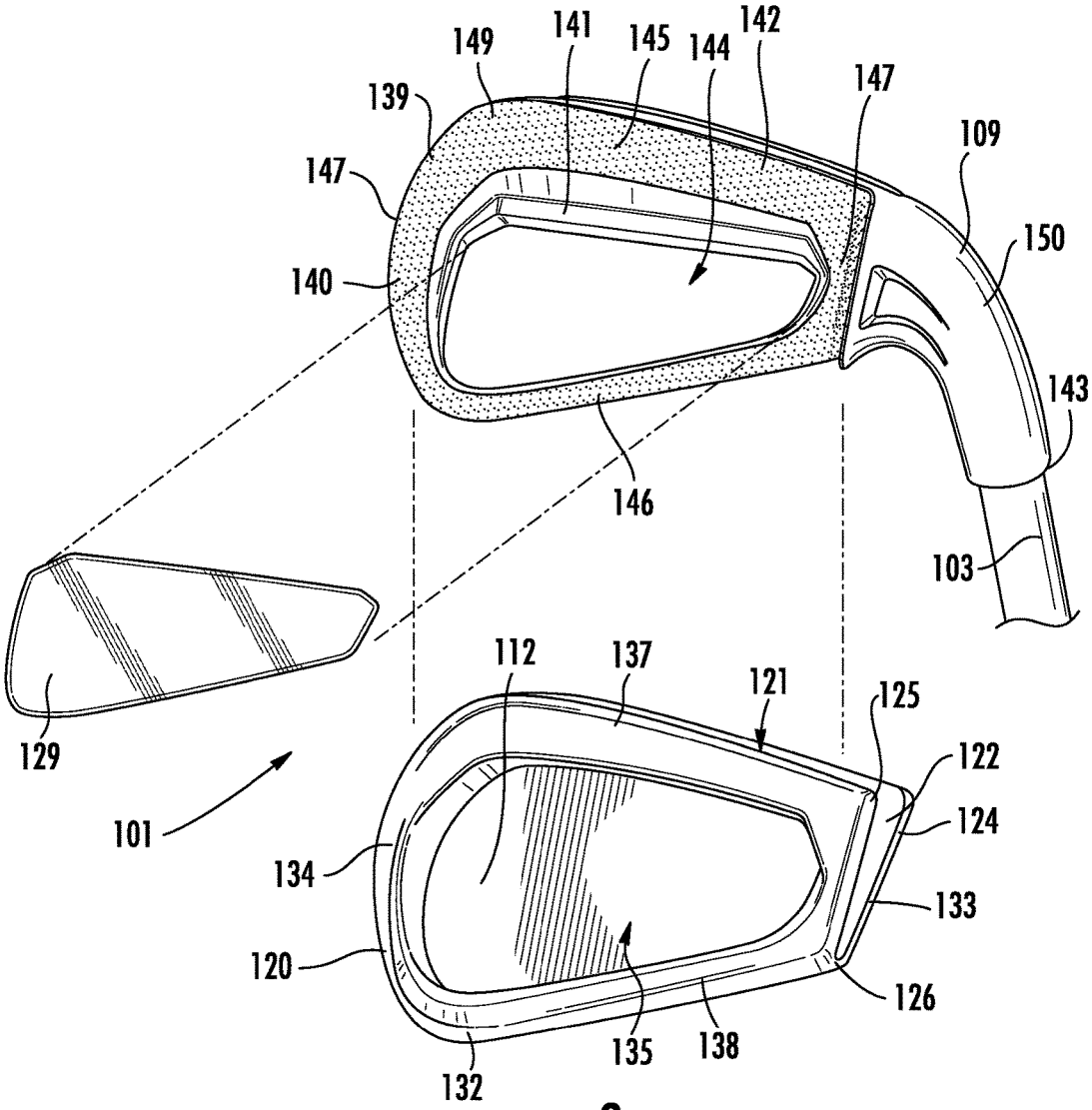
FIG. 3 is a partially exploded rear view of a head of the iron-type golf club shown in FIG. 1, having a badge connected thereto.
Figure 4:
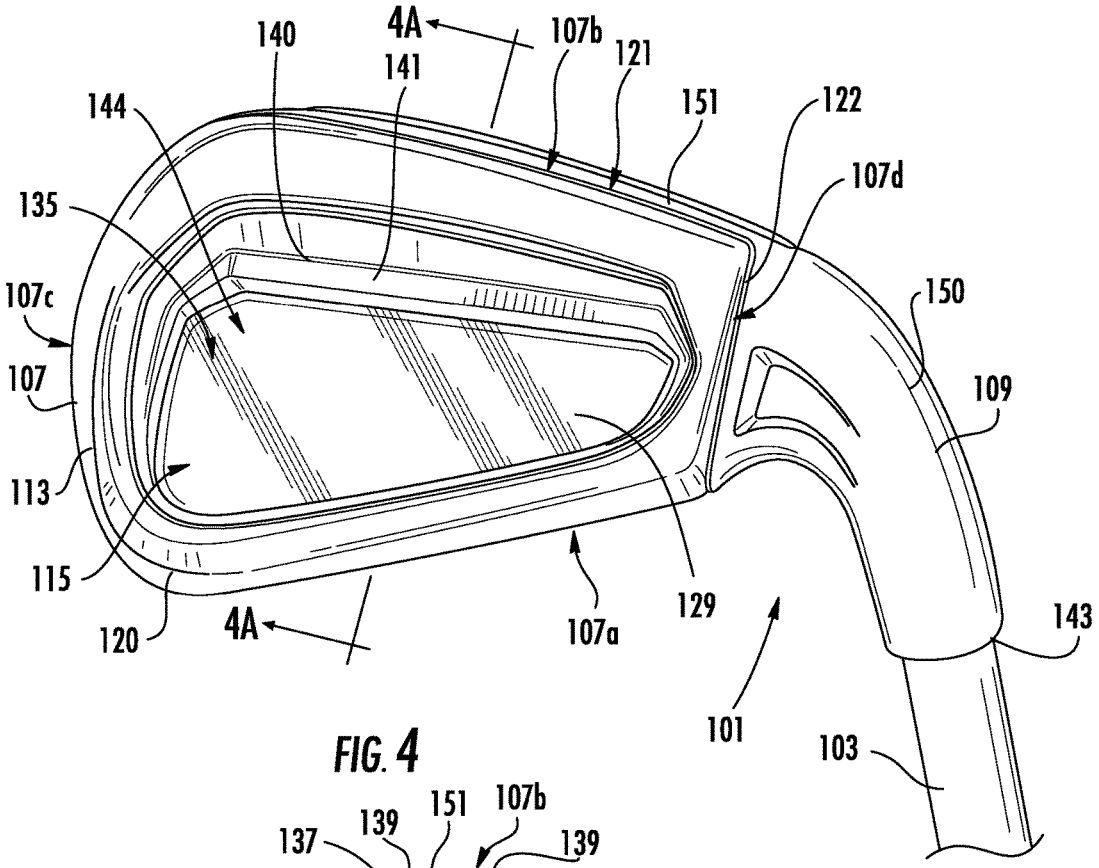
FIG. 4 is a rear view of the head of the iron-type golf club shown in FIG. 3.
Figure 4A:
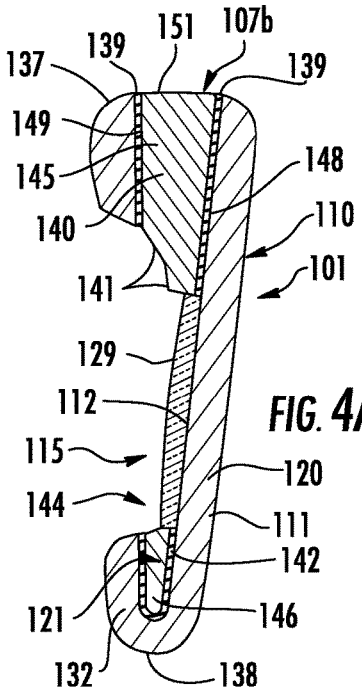
FIG. 4A is a cross-section view taken along lines 4A-4A in FIG. 4.
Figure 5:
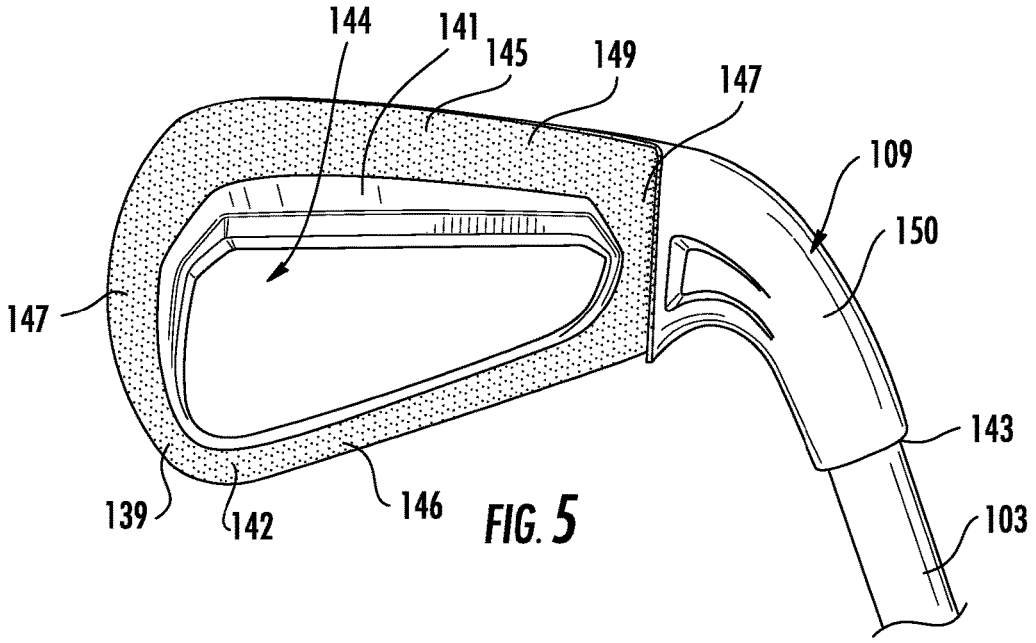
FIG. 5 is a rear view of a shaft engaging member of the head of the iron-type golf club shown in FIG. 1.

According to aspects of the disclosure, the golf club head 101 may include a golf club head body 107 and a shaft engaging member 109. Further, according to aspects of the disclosure, the golf club head body 101 may also include a ball striking face or striking face 111 that has a ball striking surface or striking surface 110 configured for striking a ball, as shown in FIGS. 1A and 4A. The face 111 may also include a rear surface 112 in one embodiment. According to aspects of the disclosure, the ball striking face 111 may have a generally trapezoidal shape which extends between a top 107*a* and a sole 107*b* of the golf club head body 107 and, further, extends substantially between a toe 107*c* and a heel 107*d* of the golf club head body 107. Of course, the ball striking face 111 may have other configurations as well. According to further aspects of the disclosure, the ball striking face 111 may be comprised of one or more materials. The material(s) of the ball striking face should be relatively durable to withstand the repeated impacts with the golf ball. As some more specific examples, the ball striking face 111 may comprise high-strength steel, titanium, or other metals (including alloys).

Further, according to aspects of the disclosure, the ball striking face 111 may include one or more score lines or grooves 106 that extend generally horizontally across the ball striking face 111 (when the club is oriented in a ball address orientation). The grooves 106 may interact with the dimpled surface of the golf ball during the impact of the golf club head 101 with a golf ball (e.g., during a golf swing) and affect the aerodynamics of the golf ball during the golf shot. For example, the grooves 106 may cause a spin (e.g., back spin) of the golf ball during the golf shot.

In the embodiment shown in FIGS. 1-6, the head 101 may be formed of a first member or shaft engaging member 109 that is configured for connection to a shaft 103 and a second member or body member 120 connected to the shaft engaging member 109. The body member 120 and/or the shaft engaging member 109 may each be made of an integral, unitary, one-piece construction in one embodiment, or the body member 120 and/or the shaft engaging member 109 may be made from a multi-piece construction in another embodiment. The face 111 is formed integrally as part of a unitary, one-piece construction with the body member 120 in the embodiment shown in FIGS. 1-6, and the body member 120 further defines other portions of the club head body 107, such as a weighting member 113 located rearward of the face 111. According to other examples, the ball striking face 111 may constitute a separate element, such as a face plate, which is configured to be engaged with the body member 120. For example, the body member 120 may include a structure, such as a recess, notch, frame or other configuration for receiving the face plate, and the face plate may be engaged in a variety of ways. In this configuration, the face plate may be engaged with the body member 120 by press fitting; bonding with adhesives or cements; welding (e.g., laser welding), soldering, brazing, or other fusing techniques; mechanical connectors; etc. Other portions of the body 107 may be formed as separate pieces in other embodiments.

According to aspects of the disclosure, the golf club head 101 and its components may be constructed in any suitable or desired manner and/or from any suitable or desired materials without departing from this disclosure, including from conventional materials and/or in conventional manners known and used in the art. For example, the club head 101 and/or its various parts may be made by forging, casting, molding, and/or using other techniques and processes, including techniques and processes that are conventional and known in the art. The golf club head 101 may be made of a variety of materials, including materials described above, such as titanium, stainless steel, aluminum, and/or other metallic materials, as well as polymers (including fiber reinforced polymers) and other types of materials. Various portions of the head 101, such as the shaft engaging member 109 and/or the body member 120, may each be made of a single, integral piece, such as by casting, forging, molding, etc., or may be made of multiple pieces connected together using appropriate techniques. In one embodiment, at least part of the head 101 (e.g., shaft engaging member 109 and/or the body member 120) may be formed of a nanocoated or other coated lightweight material, such as a high strength polymer (e.g., an injection molded plastic) that is coated with a thin layer of a metallic material. For example, in one embodiment, the body member 120 may be partially or entirely formed of a high strength polymer such as polyether ether ketone (PEEK) or other high strength polymer, coated with aluminum or other metal. Such a formation can create a complex structure for the body 107 with sufficient strength for performance, while also providing a lightweight structure, which may give the body member 120 a lower weight and/or density than the shaft engaging member 109.

Additionally, by using a lightweight coated polymer structure, the head 101 can be manufactured so that a significant portion (even a majority) of the weight of the head can be provided by the shaft engaging member 109. For example, in one embodiment, the shaft engaging member 109 may make up about 25-70% of the mass of the head 101. Further, in embodiments where the majority of the mass of the shaft engaging member 109 is positioned below the center of gravity (CG) of the body 107, this configuration can create an overall lower center of gravity for the head 101. Such a lower center of gravity may be desirable for certain clubs and/or golfers, such as to provide a higher ball flight trajectory. A shaft engaging member 109 as shown in FIGS. 1-6 can also, for example, provide greater moment of inertia (MOI) for the head 101. A configuration where the majority of the mass of the club head 101 is provided by the shaft engaging member 109 permits a wider variety of weighting configurations (e.g., CG, MOI, etc.). The base portion or base member 140 of the shaft engaging member 109 can be dimensioned in many different ways to achieve a particular weighting configuration, without necessarily being restricted by ball striking functionality (e.g., by including no material at the center), and the lighter body member 120 can then be used to provide such ball striking functionality.

According to aspects of the disclosure, the golf club head body 107 may be a blade type iron golf club head, a perimeter weighted and/or cavity back type iron golf club head, a half cavity iron type golf club head, or other iron-type golf club head structure. It is understood that the shape and configuration of the body member 120 may define, at least in part, the shape and configuration of the golf club head body 107. The body member 120 in the embodiment of FIGS. 1-6 has a ring-shaped perimeter member 132 that extends around the periphery of the body member 120 and has a center opening 135. This configuration defines the weighting member 113 in the form of a ring-shaped perimeter weighting member 113 that extends around at least a portion of the periphery of the body 107 and at least partially defines a rear cavity 115 of the club head body 107 located behind the face 111, with the center opening 135 at least partially forming the rear cavity 115. In the embodiment shown in FIGS. 1-6, the perimeter weighting member 113 extends rearwardly around the entire periphery of the body 107 and combines with the rear surface 112 of the face 111 to define the rear cavity 115. Portions of the shaft engaging member 109 may also partially define the rear cavity 115, as described below. The resultant club head body 107 has a perimeter weighted, cavity-back configuration in this embodiment. In other embodiments, the body member 120 may have a different shape and configuration. For example, the body member 120' in FIGS. 7, 8, and 8A, which has a shape defining a solid-body or blade-type head configuration, with no opening 135. In another embodiment, the body member 120 may have a rear wall extending from a sole portion of the perimeter member 132 into the center opening 135 and bridging a portion of the center opening 135, or may include a different type of bridge member or bridging structure that bridges the center opening 135.

According to aspects of the disclosure, the golf club head body 107 may include a top 107*a*, a sole or bottom 107*b*, a toe end 107*c*, and a heel end 107*d*. Further, as seen in FIG. 1A, according to aspects of the disclosure, the golf club head body 107 may be configured in a generally trapezoidal shape. According to aspects of the disclosure, at least a portion of the heel end 107*d* of the golf club head body 107 may be flat or substantially flat. For example, at least a portion of the heel end 107*d* of the golf club head body 107 may formed as a relatively flat surface that extends in a plane substantially perpendicular to the sole 107*b* of the golf club head body 107. The body member 120 may include a heel surface 133 that defines such a relatively flat surface, and the heel surface 133 may extend in a substantially vertical plane when the golf club head 101 is at the ball address position. Further, according to aspects of the disclosure, the heel surface 133 of the body member 120 may have a tapered configuration wherein the heel surface 133 becomes narrower as it extends vertically upward from the sole 107*b*, such that the lower portion of the heel surface 133 is wider than the upper portion of the heel surface 133. It is understood that the heel surface 133 may include multiple surfaces in another embodiment. The body member 120 may also include a toe surface 134, a sole surface 137, and a top surface 138 that at least partially define the toe end 107*c*, the sole 107*b*, and the top 107*a* of the body 107, respectively.

The body member 120 may have various connecting structure for connection to the shaft engaging member 109. In one embodiment, the body member 120 has a receiving slot 121 that receives the shaft engaging member 109, with an opening 122 defined in the outer surface of the body member 120 that is in communication with the receiving slot 121 for insertion of the shaft engaging member 109. For example, the opening 122 may be in the form of a slit that extends around at least a portion of the periphery of the body member 120, such as in the embodiment of FIGS. 1-6. In one embodiment, the opening 122 extends at least within the heel surface 133 of the body member 120, to permit a portion of the shaft engaging member 109 to protrude from the opening 122 at the heel end 107*d* of the body 107. In the embodiment of FIGS. 1-6, the opening 122 extends vertically through at least a portion of the heel and toe surfaces 133, 134 and extends laterally completely across the sole surface 137, from the heel surface 133 to the toe surface 134. The shaft engaging member 109 can be inserted through the opening 122 and into the slot 121, as described in greater detail herein. The slot 121 may be defined by a plurality of interior surfaces. In the embodiment of FIGS. 1-6, the slot 121 is defined at least partially by the rear surface 112 of the face 111 and by the front surface 123 of the perimeter member 132. In this configuration, slot 121 divides the majority of the body member 120 into two halves, and the body member 120 may be viewed as having two legs 124, 125 joined at a base 126, where the two legs 124, 125 extend from the base 126 and diverge from each other. In the embodiment illustrated in FIGS. 1-6, the base 126 is near the top surface 138 of the body member 120, and the legs 124, 125 diverge toward the bottom surface 137. A first leg 124 includes the face 111, and a second leg 125 includes the perimeter member 132 in this configuration.

In other embodiments, the body member 120 may be differently configured, and/or the head 101 may contain multiple body members 120. For example, the body member 120 as shown in FIGS. 1-6 may be divided into two, three, or more separate members in another embodiment, and the face 111 may be formed of a separate piece in one embodiment, as discussed above. It is understood that the body member 120 in all embodiments may affect or influence the center of gravity of the head 101. Additionally, the body member 120 may be made of any of a variety of different materials, which may be selected based on their weight or density, or based on other properties. The body member 120 may be configured to have a specific density and/or to have areas of locally increased density in one embodiment. For example, the body member 120 may be made from a metallic material such as titanium, or a polymeric material, and may include weighted inserts or other inserts, portions doped with dense materials, etc., for this purpose. In another embodiment, the body 107 formed by the body member 120 may include a perimeter weighting member 113 that is configured differently from the perimeter weighting member 113 as shown in FIGS. 1-6. For example, the perimeter weighting member 113 may extend rearward from the peripheral edges of the face 111 around only a portion of the periphery of the body 107, such as extending at least along the sole 107*b* of the head 107.

The head 101 also includes a shaft engaging member 109 that is connected to the body member 120 and is configured for connection to the shaft 103. The shaft engaging member 109 generally includes a base or base member 140 and an arm 150 extending from the base member 140 and configured for connection to the shaft 103. The base member 140 is configured to be at least partially received within the receiving slot 121 in the body member 120, as described in greater detail below. The arm 150 extends away from the base member 140 and is at least partially positioned on the exterior of the body member 120. It is understood that a portion of the arm 150 may also be received within the receiving slot 121 in one embodiment. The arm 150 may include a hosel 143 or other structure for connection to the shaft 103, as described elsewhere herein.

The base member 140 in the embodiment of FIGS. 1-6 includes a perimeter member 142 that extends around at least a portion of the periphery of the base member 140, and a cavity 144 positioned within the base member 140, with the cavity 144 having a periphery defined by the perimeter member 142. In one embodiment, illustrated in FIGS. 5-6, the perimeter member 142 extends around the entire periphery of the base member 140, and includes a bottom portion 145, a top portion 146, and two side portions 147 extending between the bottom portion 145 and the top portion 146. In this configuration, the cavity 144 is defined by edges of the bottom portion 145, the top portion 146, and the two side portions 147. The cavity 144 in this embodiment is positioned closer to the top of the base member 140, which enlarges the bottom portion 145 relative to the top portion 146 and removes mass from the top of the base member 140, lowering the CG of the base member 140. Additionally, the cavity 144 removes weight from the center of the base member 140, distributing the weight more around the perimeter of the base member 140 and increasing the MOI of the base member 140. The lowered CG and increased MOI of the base member 140, in turn, lowers the CG and increases the MOI of a club head 101 of which the base member 140 forms a portion. In other embodiments, the cavity 144 may not have a completely enclosed periphery, and instead, may be open to one or more edges of the base member 140. For example, the top portion 146 may be broken or even absent in one embodiment, creating a slot-like shape to the cavity 144.

The base member 140 in FIGS. 1-6 has a front surface 148 and a rear surface 149 located opposite each other. As shown in FIG. 4A, the base member 140 has a tapered configuration, such that a thickness defined between the front and rear surfaces 148, 149 is larger at the bottom and smaller at the top of the base member 140. In other words, the front and rear surfaces 148, 149 taper away from each other from the top to the bottom of the base member 140. In the configuration shown in FIG. 4A, the thickness of the base member 140 tapers relatively linearly from the top portion 146 through the side portions 147 and the bottom portion 145. However in other embodiments, the thickness of the base member 140 may taper or otherwise vary in a non-linear manner, such as by having stepped portions, concave/convex surfaces, etc. The bottom portion 145 may also include one or more recessed, stepped surfaces 141 at the edge of the cavity 144, such as the recessed surfaces 141 shown in FIG. 4A. The height of the base member 140 (between the top and the bottom) also tapers in the embodiment of FIGS. 1-6, such that the height is smaller near the heel 107*d* of the head 101 and larger near the toe 107*c* of the head 101. It is understood that the peripheral shape of the base member 140 may be dictated by the shape of the receiving slot 121.

Figure 7:
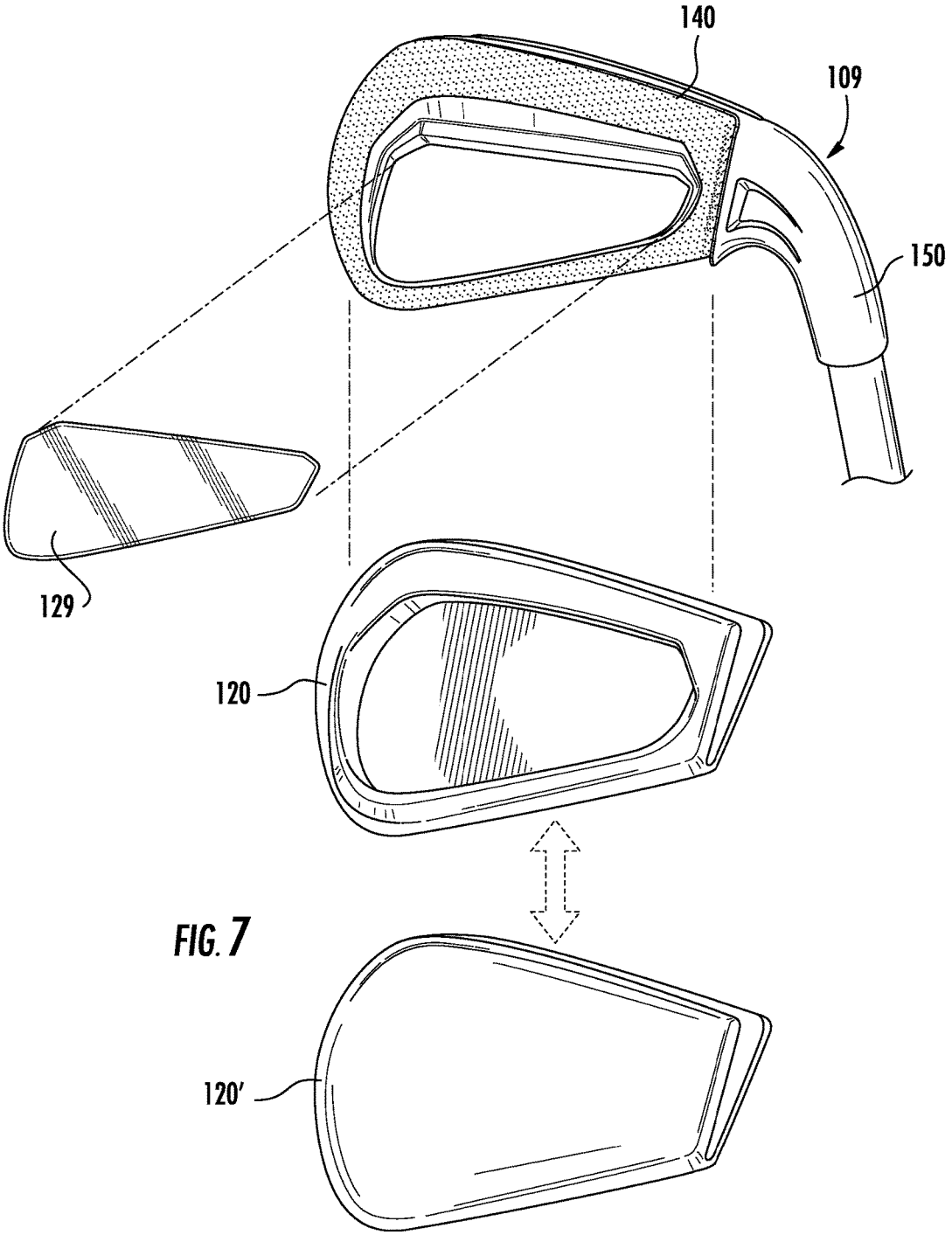
FIG. 7 is a rear exploded view of a shaft engaging member of the head of the iron-type golf club shown in FIG. 3, showing interchanging of body members.
Figure 7A:
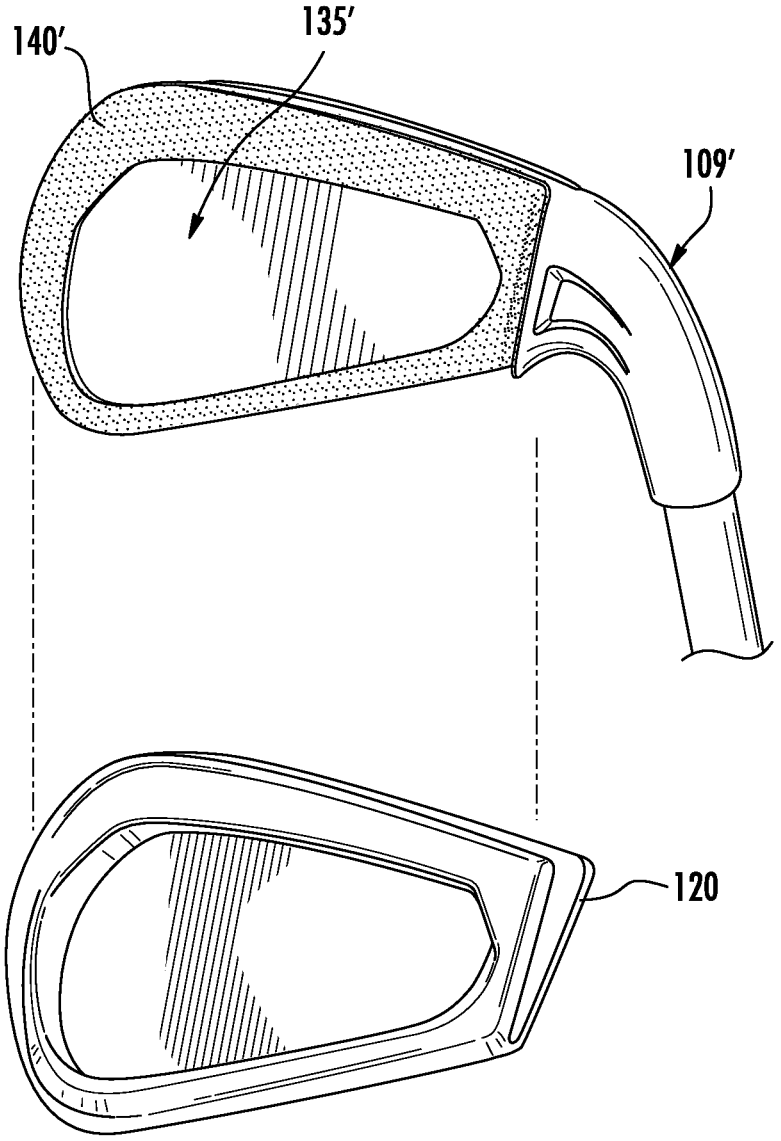
FIGS. 7A and 7B are rear exploded views of a body member of the head of the iron-type golf club shown in FIG. 3, showing connection with different shaft engaging members.
Figure 7B:
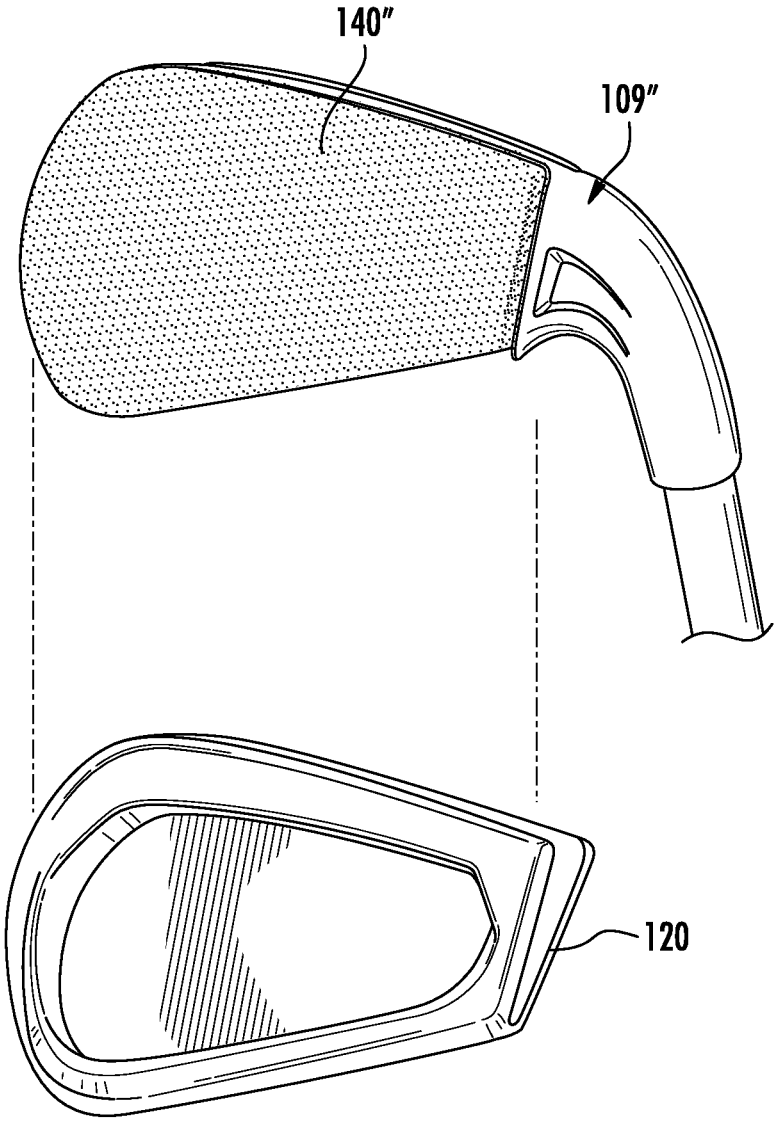

The base member 140 may have dimensions to create a specific weighting configuration, such as by having a greater or smaller amount of material in certain areas to increase or decrease the relative weight in such areas. For example, the tapered cross-section of the base member 140 creates relatively greater weighting toward the bottom of the base member 140, lowering the CG of the base member 140 and the CG of the head 101 into which the base member 140 is incorporated. As another example, the cavity 144 may be configured differently than shown in FIGS. 1-6, to remove weight from specific areas of the base member 140 in order to create a desired weighting configuration, and/or the base member 140 may include multiple cavities 144 for this purpose. Other portions of the base member 140 may be configured and dimensioned for specific weighting as well. As a further example, the base member 140 may include portions of locally increased or decreased density, such as inserts, doped portions, etc., having a different weight/density from other portions of the base member 140. In another embodiment, such as shown in FIG. 7B, the base member 140 may have no cavity.

The base member 140 is at least partially received within the slot 121 in the body member 120 to connect the shaft engaging member 109 to the body member 120, thereby enabling connection of the shaft 103 to the body member 120. The base member 140 is inserted through the opening 122 in the body member 120 and into the slot 121, and the inner surfaces defining the slot 121 engage the outer surfaces of the base member 140. In the embodiment of FIGS. 1-6, the rear surface 112 of the face 111 engages and/or confronts the front surface 148 of the base member 140, and the front surface 123 of the perimeter member 132 engages and/or confronts the rear surface 149 of the base member 140. Additionally, the base member 140 in FIGS. 1-6 has surfaces that are exposed within the opening 122 when the base member 140 is received within the slot 121. As shown in FIGS. 1-6, the base member 140 has exposed surfaces 151 that include the entire bottom surface and portions of the heel and toe surfaces of the base member 140, which are exposed by the opening 122. In this embodiment, the exposed surfaces 151 of the base member 140 form portions of the outer surface of the club head body 107. Additionally, in this embodiment, the exposed portions of the base member 140 are flush or substantially flush with the adjacent surfaces of the body member 120, to create a smooth outer profile, as seen in FIGS. 4 and 4A. As used herein, "substantially flush" means that a surface of one article is level and aligned with the surface of an adjacent article, such that the two surfaces form a substantially flat single surface, within a tolerance of +/−0.005 inches. Further, the arm 150 and the base member 140 of the shaft engaging member 109 engage each other through the portion of the opening 122 in the heel surface 133 of the body member 120.

Figure 9:
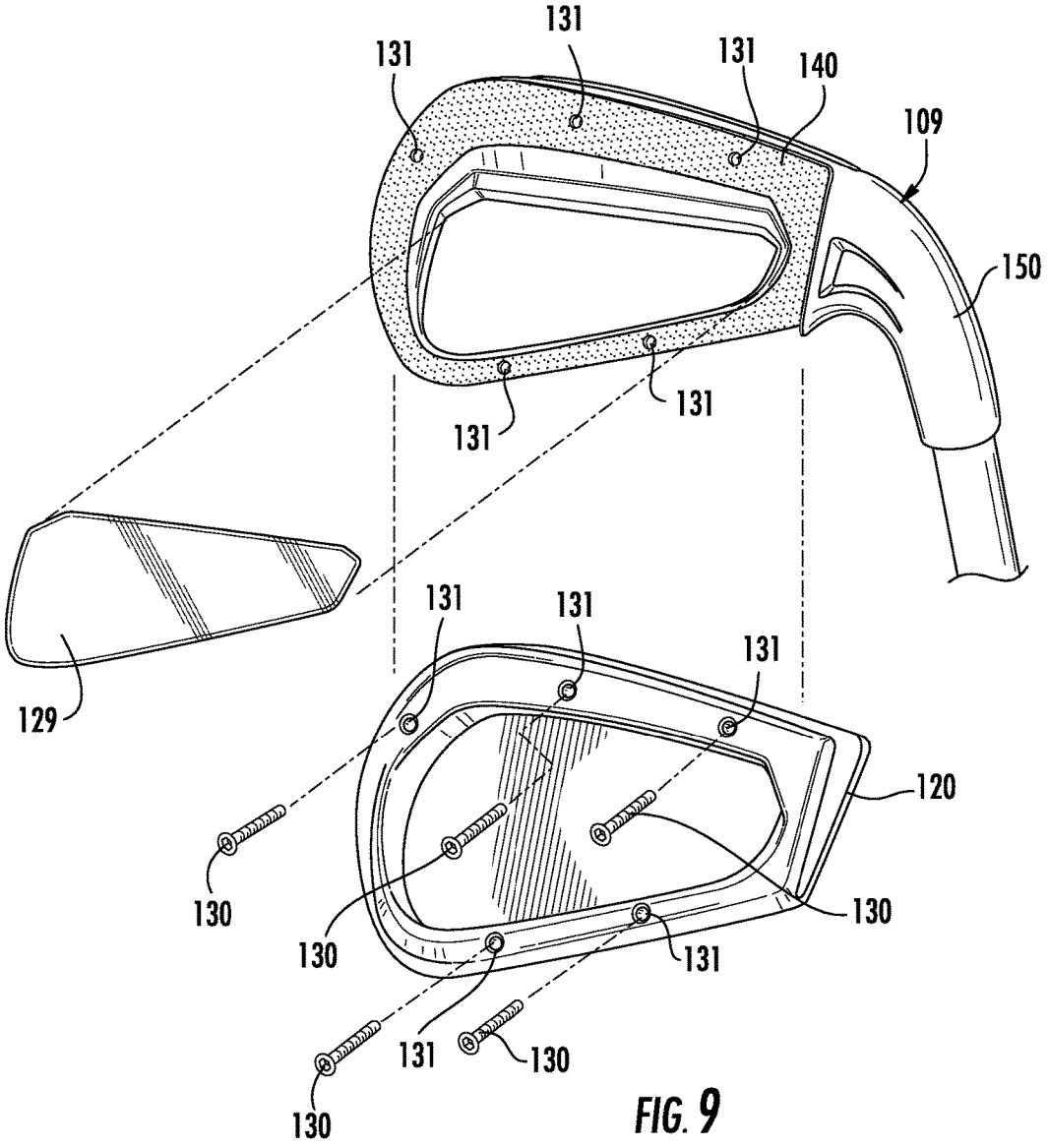
FIG. 9 is a rear exploded view of another illustrative embodiment of an iron-type golf club head according to aspects of the disclosure.

The base member 140 may be retained within the slot 121 by a variety of different techniques and structures, including fasteners, resilient retaining tabs or other structures, complementary interlocking structures (e.g., tab/recess, groove/slot, etc.), movable locking structures, friction or interference fit, adhesives or other bonding materials, or other structures and techniques, or combinations of the same. For example, FIG. 9 illustrates an embodiment including a body member 120 and a shaft engaging member 109 as shown in FIGS. 1-6, which are connected by a plurality of fasteners 130 (e.g., screws, bolts, etc.) that are received in holes 131 through the body member 120 and the base member 140. It is understood that the holes 131 may be threaded. In this embodiment, the holes 131 extend only through the perimeter weighting member 132 (i.e., the second leg 125) and through at least a portion of the base member 140, but do not extend into the face 111 (i.e., the first leg 124). The fasteners 130 are inserted from the rear in this embodiment. However, in another embodiment, the holes 131 may further extend at least partially through the face 111, and/or the fasteners 130 may be inserted from the front instead of the rear of the body member 120. It is understood that the configuration shown in FIG. 9 may be used with any embodiment or variation described herein.

In one embodiment, as shown in FIGS. 1-6, the center opening 135 of the body member 120 extends completely through the second leg 125 of the body member 120, such that the center opening 135 and the rear cavity 115 are both in communication with the receiving slot 121. In this configuration, portions of the base member 140 of the shaft engaging member 109 are exposed within the rear cavity 115. In the embodiment of FIGS. 1-6, the areas of the bottom portion 145, top portion 146, and two side portions 147 defining the edges of the cavity 144 are exposed within the center opening 135 and the rear cavity 115, including the recessed surfaces 141 proximate the cavity 144. Additionally, the cavity 144 of the base member 140 is in communication with the center opening 135 and the rear cavity 115 in this embodiment, and the cavity 144 may therefore be considered to define a portion of the rear cavity 115. The rear surface 112 of the face 111 may, therefore, also be exposed in the rear cavity 115 in this configuration. In one embodiment, the resilient material 139 covers only surfaces of the base member 140 engaged with the body member 120, and does not cover any exposed surfaces.

In one embodiment, the head 101 may further include a badge 129 that is positioned within the rear cavity 115 to cover one or more of the exposed surfaces therein. As shown in FIGS. 1-6, the head 101 includes a badge 129 that is received within the cavity 144 of the base member 140 and has a periphery that is complementarily dimensioned with the edges defining the cavity 144 so as to fill the cavity 144. The badge 129 in this configuration covers the exposed portions of the rear surface 112 of the face 111. The badge 129 may be made from a metal, polymer, composite, or other suitable material, and may be at least partially transparent or translucent in one embodiment. The badge 129 may also include indicia such as logos, graphic designs, performance information, etc. The badge 129 in the embodiment of FIGS. 1-6 is connected to the body 107 by an adhesive or other bonding material, however the badge 129 may be connected to the body 107 by any suitable technique described herein. In another embodiment, the badge 129 may cover different or additional surfaces of the body 107, and/or the head 101 may include multiple badges 129 or no badge 129 at all. Further, the head 101 may be configured to have multiple badges 129 connected thereto, and such badges 129 may be removably connected to the body 107 so as to be interchangeable.

The base member 140 may have a resilient material or resilient member 139 positioned on at least one of the front and rear surfaces 148, 149 and covering at least one of the front and rear surfaces 148, 149. The resilient material 139 may be engaged by the inner surfaces of the slot 121, thereby providing cushioning and/or frictional engagement between the base member 140 and the body member 120. FIG. 4A illustrates the engagement between the resilient material 139 and the body member 120. In the embodiment of FIGS. 1-6, the base member 140 has the resilient material 139 covering substantially the entire front surface 148 and rear surface 149 of the base member 140. In another embodiment, the resilient material 139 may cover at least a majority of the front surface 148 and/or at least a majority of the rear surface 149 of the base member 140. In other embodiments, the resilient material 139 may not cover some portions of the front and/or rear surfaces 148, 149, and/or the entire front or rear surface 148, 149 may not be covered. The resilient material 139 does not cover the inner edges of the base member 140 defining the cavity 144, and also does not cover the outer edges of the base member 140, including the exposed edges 151, in the embodiment of FIGS. 1-6. In other embodiments, the resilient material 139 may cover some or all of these surfaces, and may cover the entire base member 140 in one embodiment.

The resilient material 139 may be made from an elastomeric material, such as a polyurethane material, natural or synthetic rubber, a silicone material, a thermoplastic (TPE) vulcanizate, or other type of resilient material, and may be a foamed material in one embodiment. In one embodiment, the resilient material 139 may be formed as a coating on the base member 140 (e.g., a spray or dip coating), and in another embodiment, the resilient material 139 may include one or more separately-formed resilient members that are subsequently connected to the base member 140, e.g., by adhesive or other bonding material. Combinations of such techniques may be used in other embodiments. Surfaces of the base member 140 may be treated to increase adhesion of the resilient coating/member. The resilient material 139 may have a hardness of from 70 Shore A to 70 Shore D in one embodiment. Additionally, the resilient material may have a thickness of from 1-5 mm in one embodiment.

The properties of the base member 140 may influence the performance of the club head 101 in different ways. For example, as discussed herein, the weighting of the base member 140 may significantly affect the overall weighting of the head 101, such as CG position, MOI, etc., which can change the performance of the club head 101. Higher MOI can provide increase resistance to twisting of the head 101 on off-center impacts, thereby increasing energy/momentum transfer and distance on off-center impacts, as well as straighter shots, on such off-center impacts. Moving the CG can create higher or lower ball flight, cause the face 111 to impart different spin on the ball, compensate for user hitting tendencies, etc. As another example, the mechanical properties of the base member 140 may affect the impact properties of the face 111, such as by absorbing impact, dissipating vibrations, exerting a response force on the face 111, etc. Further examples exist and are recognizable to those skilled in the art.

The shaft engaging member 109 also includes the arm 150 that extends outwardly and/or upwardly from the base member 140, and the arm 150 is configured for direct or indirect connection to the shaft 103. The arm 150 connects to the base member 140 proximate the heel 107*d*. The arm 150 also includes a shoulder portion 152 that has an engaging surface 153 that is configured to confront the heel surface 133 of the body member 120 and engage the heel surface 133 in surface-to-surface contact. In the embodiment of FIGS. 1-6, the heel surface 133 is substantially flat, and the engaging surface 153 is substantially flat to conform to the contour of the heel surface 133. In other embodiments, the heel surface 133 and the engaging surface 153 may have different conforming contours. Additionally, the shoulder portion 152 may have outer surfaces that are substantially flush and/or contiguous with adjacent surfaces of the body member 120 and/or the body 107, such as the striking surface 110, the top 107*a*, the sole 107*b*, and the perimeter weighting member 113, to create a substantially seamless appearance. The arm 150 is also configured for connection to the shaft 103. In the embodiment of FIGS. 1-6, the arm 150 has a hosel 143 configured for connection to the shaft 103, and the hosel 143 may be configured for such connection in a releasable and/or adjustable manner using mechanical connectors to allow easy interchange of one shaft for another on the head and/or to allow adjustment of the orientation of the shaft 103 with respect to the golf club head body 107. For example, threads, locking mechanisms, fasteners, etc. may be arm 150, and the end of the shaft 103 that is to be engaged with arm 150 may be configured with a corresponding configuration. Alternatively, the shaft 103 may be secured via other mechanisms, such as bonding with adhesives or cements, welding (e.g., laser welding), soldering, brazing, or other fusing techniques, etc.

Further, optionally, if desired, the hosel may be eliminated and the shaft 103 may be otherwise attached to the golf club head 101 through the shaft engaging member 109 of the golf club head 101. For example, the shaft 103 may be otherwise engaged with the shaft engaging member 109 by butt welding, laser welding, other type of welding; bonding with adhesives or cements, soldering, brazing, or other fusing techniques; etc. In a further embodiment, the shaft engaging member 109 may be integrally formed with the shaft 103, e.g., the arm 150 of the shaft engaging member 109 may be integrally formed with the shaft 103, rather than the shaft 103 being removable from the shaft engaging member 109 as described above.

Figure 6:
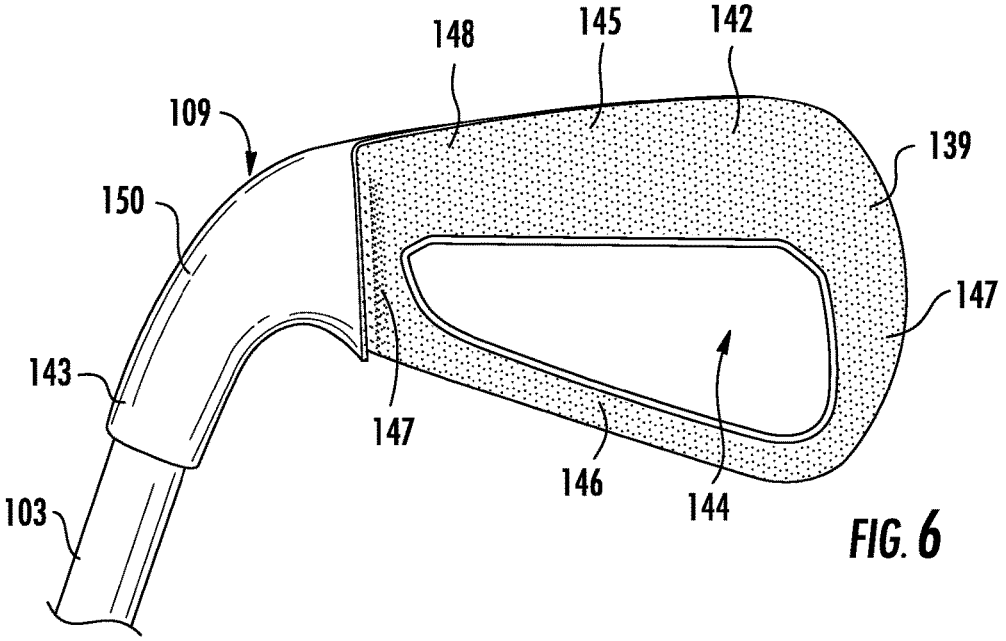
FIG. 6 is a front view of the shaft engaging member of FIG. 5.
Figure 6A:
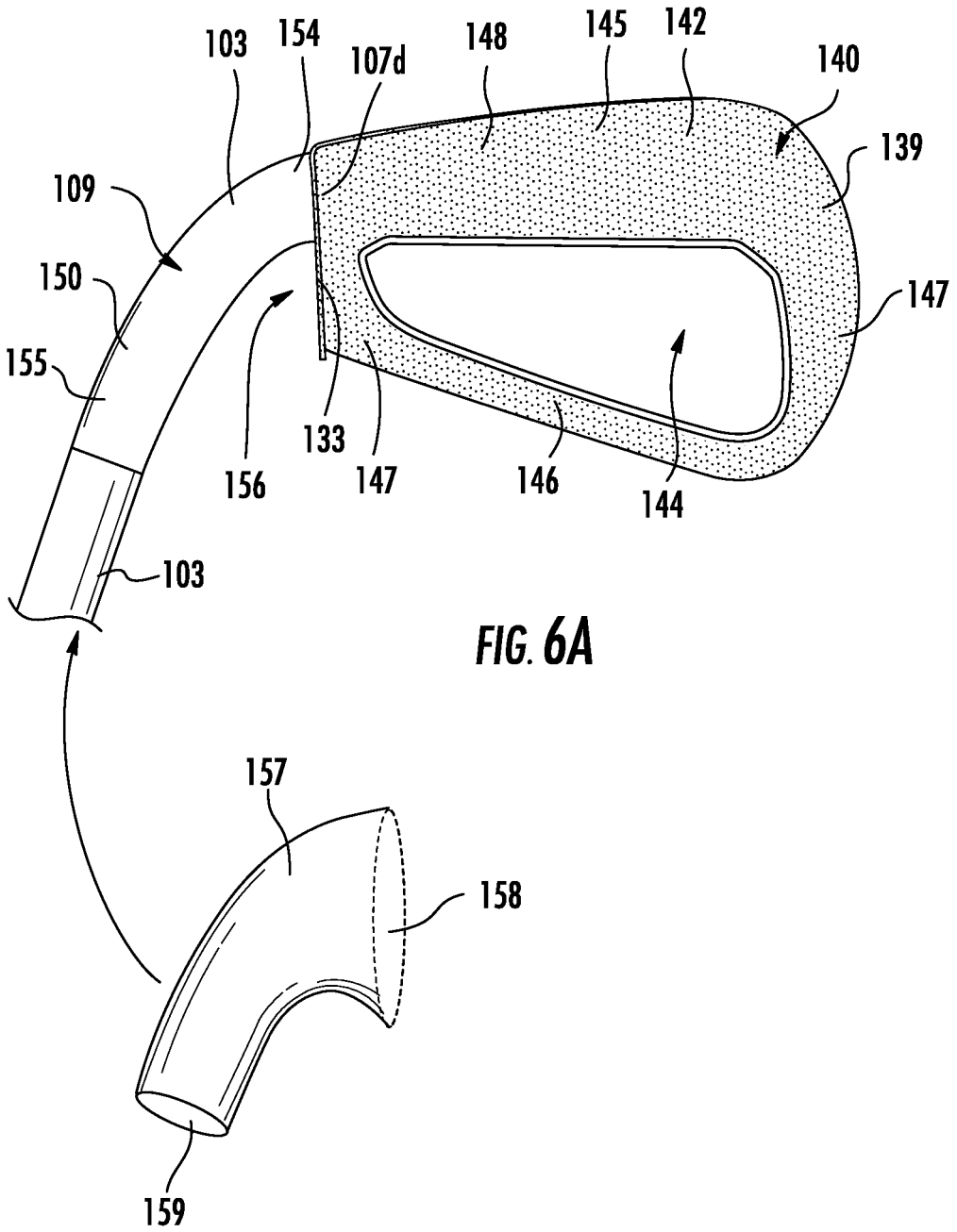
FIG. 6A is a rear view of another illustrative embodiment of an iron-type golf club head according to aspects of the disclosure.

In another embodiment, the arm 150 may have a connection to the base member 140 that is located below the center of gravity of the golf club head 101 and/or below the center of gravity of the club head body 107 and/or below the geometric center of the ball striking face 111, as shown in FIG. 6A. In this embodiment, the arm 150 has a horizontally-extending (first) portion 154 that is connected to the base member 140 and an upwardly-extending (second) portion 155 that extends upwardly and/or outwardly from the first portion 154 and is connected to the shaft engaging structure. Additionally, in this embodiment, a gap 156 may exist between the second portion 155 and the heel 107*d* of the body 107, and the head 101 may include a shroud 157 that at least partially bridges the gap 156. As illustrated in FIG. 6A, the shroud 157 covers at least a portion of the second portion 155 and the first portion 154, and extends from the second portion 155 across the gap 156 to the heel 107*d*. The shroud 157 may also cover a portion of the heel surface 133 of the body member 120. The shroud 157 may receive at least a portion of the first portion 154 and/or the second portion 155 of the shaft engaging member 109 to accomplish this function. The shroud 157 may be purely cosmetic in one embodiment, and may be configured to create the appearance of an integral hosel. In other embodiments, the shroud 157 may serve a structural or other functional purpose. In the embodiment of FIG. 6A, the shroud 157 receives and partially covers the first and second portions 154, 155 of the arm 150, and completely covers the heel 107*d* of the body 107. The shroud 157 in this embodiment has two end openings 158, 159. The second opening 159 receives the second portion 155 of the arm 150 therethrough, and the first opening 158 allows the first portion 154 of the arm 150 to connect to the base member 140. The first opening 158 also engages and surrounds the flat heel surface 133 at the heel 107*d* of the body 107 in this embodiment. The shroud 157 as shown in FIG. 6A has a flared end portion around the first opening 158, such that the first opening 158 is also flared. Further, the shroud 157 (or the flared end portion thereof) may have surfaces that are substantially flush and/or contiguous with one or more surfaces of the golf club head body 107 around the heel 107*d*, such as the top 107*a*, the sole 107*b*, the face 111, and/or the rear of the perimeter weighting member 113. The shroud 157 may be a shell made from plastic or other polymer material (including fiber reinforced polymers or other composites) in one embodiment, however it is understood that other materials may be used in other embodiments. It is further understood that the shroud 157 may have a different configuration in another embodiment. The club head 101 in FIG. 6A is otherwise identical to the club head in FIGS. 1-6.

The shaft engaging member 109 may be entirely or substantially formed of a single, integral piece, such as by molding, forging, etc. For example, in one embodiment, the base member 140 and the arm 150 may be formed of a single, integral piece, with the hosel 143 and the resilient material 139 connected to the single piece. In another embodiment, the base member 140 and the arm 150 may be made from two separate pieces that are connected together by welding, brazing, fasteners, or other joining technique. In a further embodiment, one or both of the base member 140 and the arm 150 may be made from multiple pieces.

In one embodiment, a single shaft engaging member 109 and/or base member 140 may be usable with a plurality of different body members 120 having different configurations. For example, in the embodiment illustrated in FIG. 7, a first body member 120 as shown in FIGS. 1-6 may be connected to the shaft engaging member 109, and the shaft engaging member 109 is further configured for connection to at least a second body member 120' that is configured differently from the first body member 120. In the embodiment shown in FIG. 7, the second body member 120' is configured to form a blade-type club head body 107, having no rear cavity, and is therefore differently configured from the first body member 120 for at least this reason. The second body member 120' may also have additional differentiating features, such as a different loft angle. In another embodiment, the shaft engaging member 109 may be configured for connection to additional or alternate body members, which may have various different configurations, such as different loft angles, different weighting, different structural features, different properties, etc. Further, the different body members 120, 120' may be configured for removable and interchangeable connection to the shaft engaging member 109, to allow for customization. In this embodiment, the different body members 120, 120' may have releasable connecting structure that may be complementary with the base member 140. For example, the shaft engaging member 109 and each different body member 120, 120' may be configured for connection using fasteners 130 and holes 131, as shown in FIG. 9 and discussed above, or a different releasable connecting structure. The use of different body members with the same shaft engaging member 109 also permits a reduction in necessary production parts, as multiple different club heads 101 can be manufactured using a single shaft engaging member 109, including club heads 101 with different loft angles, structural configurations, functional properties, etc. As shown in FIG. 7, a badge 129 as described above may be utilized with one body member 120, but may not be necessary if used with another body member 120'.

Additionally, different shaft engaging members 109 can be used with a single body member 120, with each different shaft engaging member 109 having a different configuration. For example, in the embodiment illustrated in FIG. 7A, the body member 120 shown in FIGS. 1-6 is configured for connection to a second shaft engaging member 109' having a base member 140' with a different configuration from the base member 140 of FIGS. 1-6. The base member 140' of the second shaft engaging member 109' has a rear cavity 135' that extends only partially through the base member 140', which is different from the opening 135 of the base member 140 in FIGS. 1-6. In the embodiment illustrated in FIG. 7B, the body member 120 shown in FIGS. 1-6 is configured for connection to a third shaft engaging member 109" having a base member 140" with a further different configuration from the base member 140 of FIGS. 1-6. The base member 140" of the third shaft engaging member 109" has a flat configuration with no opening or cavity, which is different from the base members 140, 140' in FIGS. 1-6 and 7A. The configurations in FIGS. 7A-B produce different weighting configurations from the base member 140 of FIGS. 1-6. The second and third shaft engaging members 109', 109" may also have additional differentiating features. In another embodiment, the body member 120 may be configured for connection to additional or alternate shaft engaging members, which may have various different configurations. Further, the different shaft engaging members 109, 109', 109" may be configured for removable and interchangeable connection to the body member 120, to allow for customization. In this embodiment, the different shaft engaging members 109, 109', 109" may have releasable connecting structure that may be complementary with the body member 120. For example, the body member 120 and each different shaft engaging members 109, 109', 109" may be configured for connection using fasteners 130 and holes 131, as shown in FIG. 9 and discussed above, or a different releasable connecting structure. The use of different shaft engaging members with the same body member 120 also permits a reduction in necessary production parts, as multiple different club heads 101 can be manufactured using a single body member, including club heads 101 with different weighting, impact properties, etc.

Figure 8:
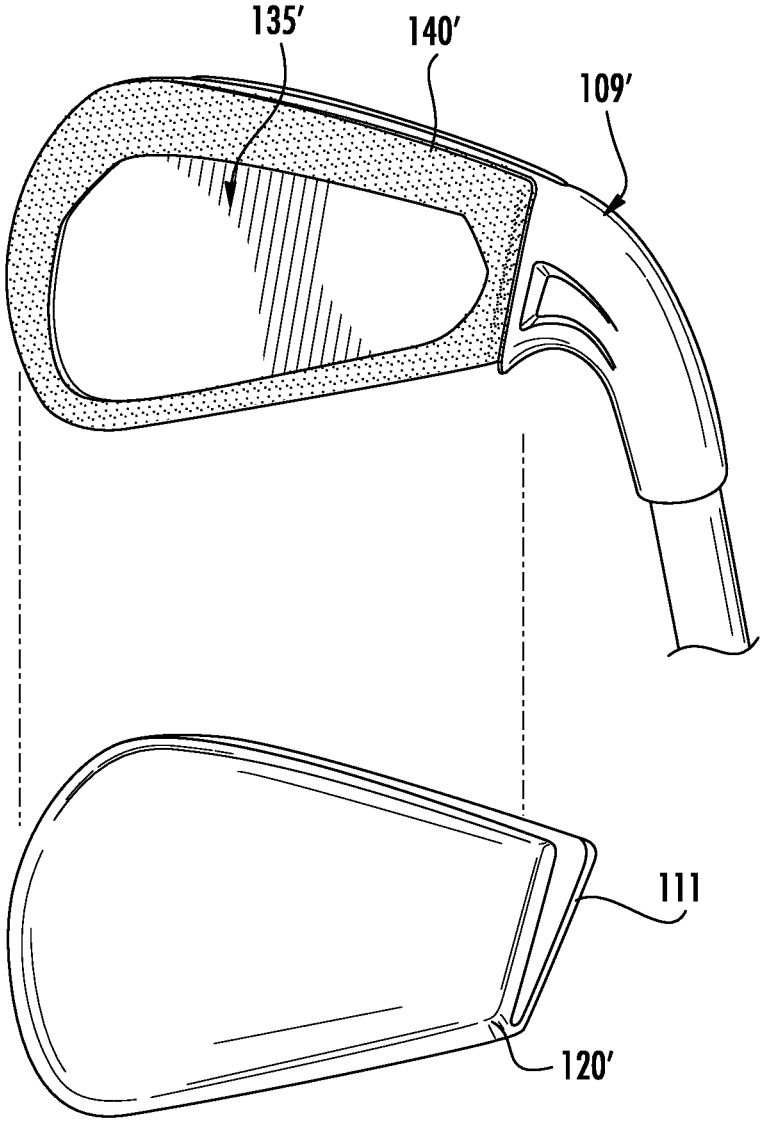
FIG. 8 is a rear exploded view of another illustrative embodiment of an iron-type golf club head according to aspects of the disclosure.
Figure 8A:
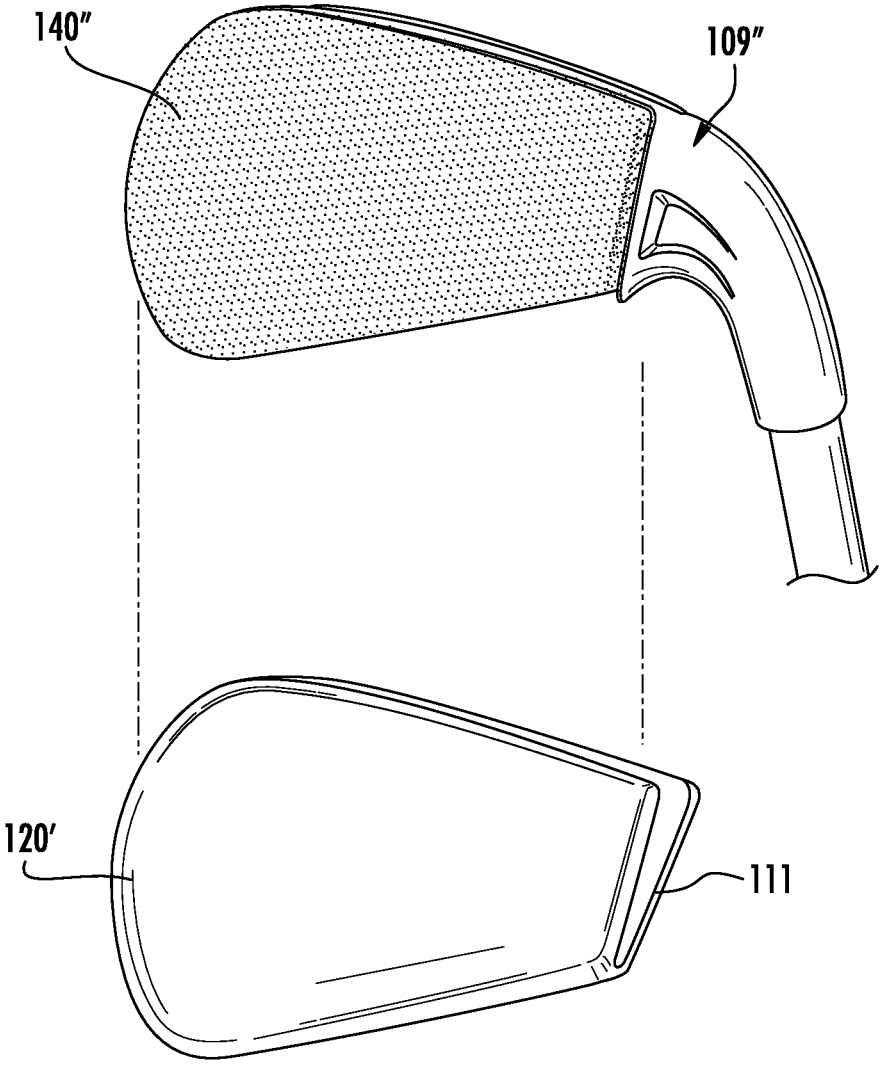
FIG. 8A is a rear exploded view of another illustrative embodiment of an iron-type golf club head according to aspects of the disclosure.

Still further, multiple shaft engaging members 109, 109', 109" may be alternately connectable to multiple body members, such as the different body members 120, 120' in FIG. 7. For example, FIG. 8 illustrates the second shaft engaging member 109' of FIG. 7A connected to the second body member 120' in FIG. 7. As another example, FIG. 8A illustrates the third shaft engaging member 109" of FIG. 7B connected to the second body member 120' in FIG. 7. This produces a blade-type iron club head 101.

Figure 10:
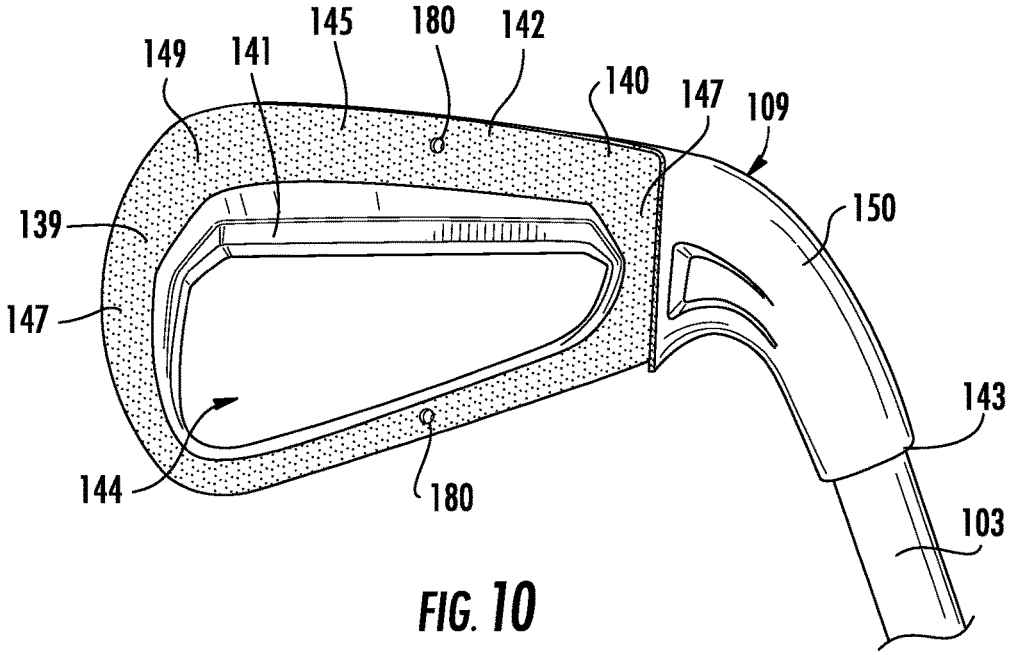
FIG. 10 is a rear view of a another illustrative embodiment of a shaft engaging member according to aspects of the disclosure.
Figure 11:
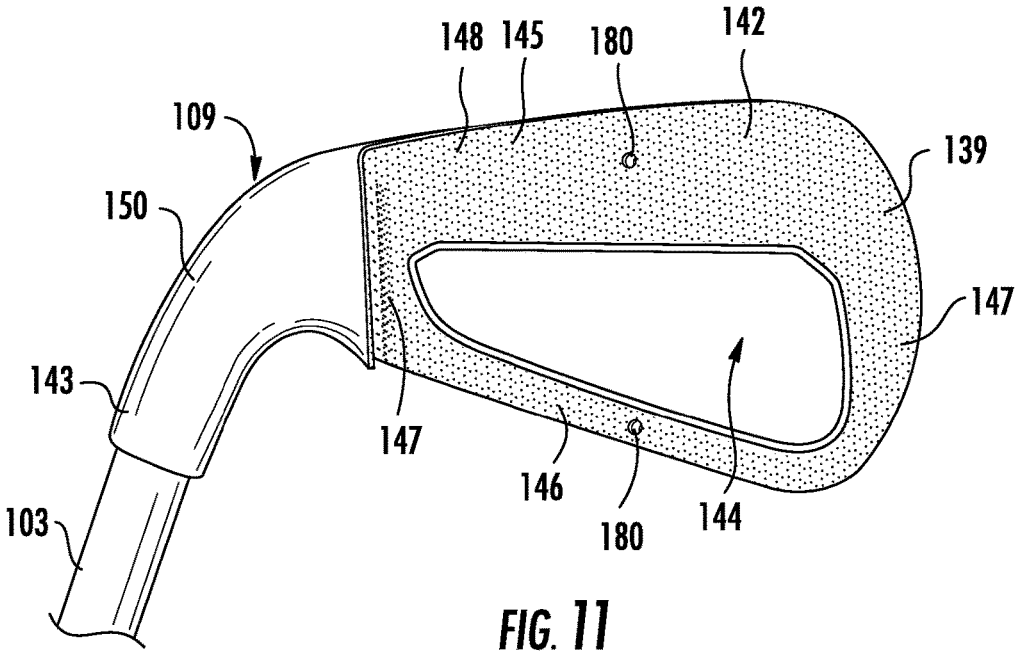
FIG. 11 is a front view of the shaft engaging member of FIG. 10.

FIGS. 10-11 illustrate another embodiment of a shaft engaging member 109 that has rigid engagement members 180 on the front and rear surfaces 148, 149 of the base member 140, which have a greater stiffness, hardness, or rigidity than the resilient material 139. These rigid engagement members 180 engage the rear surface 112 of the face 111 and the front surface 123 of the perimeter member 132 when the head 101 is assembled. In the embodiment shown in FIGS. 10-11, the engagement members 180 are small domed or spherical projections that are fixed to the surfaces 148, 149 of the base member 140, however the engagement members 180 may have a different configuration in other embodiments. These engagement members 180 allow for transfer of energy and/or momentum from the base member 140 to the face 111 during off-center impacts, such as described in U.S. Patent Application Publication No. 2013/0137533, filed Nov. 30, 2011, which application is incorporated by reference herein in its entirety and made part hereof. In the embodiment illustrated, the engagement members 180 are generally aligned laterally with the CG of the club head 101. However, in other embodiments, the engagement members 180 may be positioned farther toward the heel 107*d* of the club head 101, providing further increased transfer of energy and/or momentum to the face 11*s* on hits more proximate the toe 107*c*. It is understood that a shaft engaging member 109 as shown in FIGS. 10-11 may be used in connection with any other embodiment described herein.

A wide variety of overall club head constructions are possible without departing from this disclosure. For example, it is noted that the dimensions and/or other characteristics of the golf club heads 101 according to examples of this disclosure may vary significantly without departing from the disclosure. For example, the above described features and configurations may be incorporated into any iron-type club heads including, for example: wedges (e.g., pitching wedges, lob wedges, gap wedges, sand wedges, etc.), iron-type hybrid clubs, driving irons, 0 through 10 irons, etc. While iron-type golf clubs and iron-type golf club heads have been described in detail above, other aspects of this disclosure may be used in connection with wood-type golf club heads, hybrid-type golf club heads, putter heads, and other types of golf club heads or other ball striking devices, including golf clubs incorporating such heads.

The various embodiments and configurations described herein produce multiple advantages over existing golf clubs and other ball striking devices. For example, the use of different body members and/or shaft engaging members in combination can simplify manufacturing by reducing the number of different parts required to produce a full set of club heads, and can thereby reduce costs and increase efficiency. In other words, a single shaft engaging member can be used to produce multiple different iron clubs having different loft angles, so that each different club does not require its own specific shaft engaging member part. As another example, different shaft engaging member configurations can create unique and/or varied weighting characteristics, while the body member provides a standard and/or consistent outward appearance. These weighting configurations, in turn, can create greater energy and/or momentum transfer to the ball on off-center hits, straighter ball flight, and/or less undesirable side-spin. As a further example, different shaft engaging members and/or body members can produce different functional properties, such as different impact properties. As yet another example, different interchangeable combinations of one or more shaft engaging members and one or more body members can provide for a wide variety of customization. As still another example, the resilient material can provide vibration damping and improved feel for the golf club head. Still other benefits and advantages are recognizable to those skilled in the art.

It is understood that any embodiments shown and described herein may incorporate one or more features shown and/or described herein with respect to any other embodiment. For example, the embodiments of FIGS. 1-6 may include any features shown and/or described herein with respect to FIGS. 7-9 or FIGS. 10-11, and vice versa. A wide variety of overall club head constructions are possible without departing from this disclosure. For example, it is noted that the dimensions and/or other characteristics of the golf club heads according to examples of this disclosure may vary significantly without departing from the disclosure.

The present disclosure is described above and in the accompanying drawings with reference to a variety of example structures, features, elements, and combinations of structures, features, and elements. The purpose served by the disclosure, however, is to provide examples of the various features and concepts related to the disclosure, not to limit the scope of the disclosure. One skilled in the relevant art will recognize that numerous variations and modifications may be made to the embodiments described above without departing from the scope of the present disclosure, as defined by the appended claims. For example, the various features and concepts described above in conjunction with FIGS. 1 through 9 may be used individually and/or in any combination or subcombination without departing from this disclosure.

What is claimed is:

1. A golf club head comprising:

a first member comprising a perimeter member and an arm extending from the perimeter member, wherein the perimeter member is a perimeter of a portion of the first member and has a cavity positioned within the perimeter member and defined by the perimeter member, wherein the arm is configured for connection of a shaft; and a second member comprising a face having a striking surface configured for striking a ball and a club head body positioned behind the face, the second member having a receiving slot positioned behind the face, wherein the perimeter member of the first member is at least partially received within the receiving slot, wherein the second member includes an opening at least partially defining a rear cavity in a rear of the body, opposite the face, and wherein the rear cavity is in communication with the receiving slot, such that at least a portion of the first member is exposed within the rear cavity.

2. The golf club head of claim 1, wherein the cavity comprises a hole completely through the perimeter member, and wherein the perimeter member extends around an entire periphery of the hole.

3. The golf club head of claim 1, further comprising a badge connected to the golf club head and received within the rear cavity.

4. The golf club head of claim 1, wherein the cavity is exposed and accessible from the rear cavity, further comprising a badge connected to the golf club head and received within the cavity and the rear cavity.

5. The golf club head of claim 1, wherein the second member has an opening in communication with the receiving slot, wherein the perimeter member is received through the opening and into the receiving slot.

6. The golf club head of claim 5, wherein the opening extends at least along a bottom surface of the second member.

7. The golf club head of claim 6, wherein the opening comprises a slit extending around a portion of a periphery of the second member, from a toe portion of the second member, across the bottom surface of the second member, to a heel portion of the second member.

8. The golf club head of claim 5, wherein the opening extends at least through a heel surface of the second member, and wherein the arm of the first member connects to the perimeter member through the heel surface.

9. The golf club head of claim 1, wherein first member is formed of a single, integral piece.

10. The golf club head of claim 9, wherein the hosel is formed as part of the single integral piece of the first member.

11. The golf club head of claim 1, wherein the first member further comprises a resilient material covering at least a portion of an outer surface of the first member.

12. The golf club head of claim 11, wherein the resilient material covers at least a portion of the outer surface on the front and rear sides of the first member.

13. The golf club head of claim 1, wherein the first member has a plurality of first apertures located in the perimeter member and the second member has a plurality of second apertures corresponding to the first apertures, such that fasteners are received through the first and second apertures to connect the first member to the second member.

14. A golf club comprising the golf club head of claim 1 and the shaft connected to the arm, wherein a hosel is connected to the arm of the first member and the shaft is connected at the hosel.

15. A golf club head comprising:

a first member comprising a perimeter member and an arm extending from the perimeter member, the perimeter member having a resilient material positioned on at least one of a front surface and a rear surface of the perimeter member, wherein the arm is configured for connection of a shaft; and a second member comprising a face having a striking surface configured for striking a ball and a club head body positioned behind the face, the second member having a receiving slot positioned behind the face, wherein the first member is at least partially received within the receiving slot, such that one or more surfaces defining the receiving slot engage the resilient material when the perimeter member of the first member is at least partially received within the receiving slot, wherein the perimeter member is a perimeter of a portion of the first member and a cavity positioned within the perimeter member, wherein the perimeter member extends around an entire periphery of the cavity and defines the cavity, and wherein the resilient material is connected to the perimeter member and extends around the entire periphery of the cavity, and wherein the cavity comprises a hole completely through the perimeter member, and wherein the resilient material extends around the entire periphery of the hole on the front surface and the rear surface of the perimeter member.

16. The golf club head of claim 15, wherein the resilient material covers at least a majority of the front surface of the perimeter member.

17. The golf club head of claim 15, wherein the resilient material covers at least a majority of the rear surface of the perimeter member.

18. The golf club head of claim 15, wherein the resilient material covers at least a majority of the front and rear surfaces of the perimeter member.

19. The golf club head of claim 15, wherein the resilient material covers substantially all of the front and rear surfaces of the perimeter member.

20. The golf club head of claim 15, wherein the second member has an opening in communication with the receiving slot, wherein the perimeter member is received through the opening and into the receiving slot.

21. The golf club head of claim 20, wherein the opening comprises a slit extending around a portion of a periphery of the second member, from a toe portion of the second member, across the bottom surface of the second member, to a heel portion of the second member.

22. The golf club head of claim 15, wherein first member is formed of a single, integral piece.

23. The golf club head of claim 22, wherein the hosel is formed as part of the single integral piece of the first member.

24. A golf club comprising the golf club head of claim 15 and the shaft connected to the arm, wherein a hosel is connected to the arm of the first member and the shaft is connected at the hosel.

25. A golf club head comprising:

a first member comprising a base member and an arm extending from the base member, the base member having a front surface and a rear surface; and a second member comprising a face having a striking surface configured for striking a ball and a club head body positioned behind the face, the second member having a receiving slot positioned behind the face and an opening in communication with the receiving slot, the opening comprising a slit extending around a portion of a periphery of the second member, across at least a portion of a heel surface of the second member and across at least a portion of a bottom surface of the second member, wherein the base member of the first member is at least partially received within the receiving slot and is received through the opening and into the receiving slot, wherein the arm of the first member connects to the base member through the slit in the heel surface, and the arm is configured for connection of a shaft, wherein the second member has inner surfaces defining the receiving slot, and wherein the inner surfaces engage the front surface and the rear surface of the first member.

26. The golf club head of claim 25, wherein the second member includes a rear cavity in a rear of the body, opposite the face.

27. The golf club head of claim 26, wherein the rear cavity is in communication with the receiving slot, such that at least a portion of the first member is exposed within the rear cavity.

28. The golf club head of claim 25, wherein the slit extends from a toe surface of the second member, across the bottom surface of the second member, to the heel surface of the second member.

29. The golf club head of claim 25, wherein first member is formed of a single, integral piece.

30. The golf club head of claim 29, wherein the hosel is formed as part of the single integral piece of the first member.

31. The golf club head of claim 25, wherein an outer surface of at least a portion of the first member comprises a resilient material covering.

32. The golf club head of claim 31, wherein the resilient material covering is at least a portion of the outer surface at the front and rear sides of the first member.

33. The golf club head of claim 25, wherein the first member has a plurality of first apertures located in the base member and the second member has a plurality of second apertures corresponding to the first apertures, such that fasteners are received through the first and second apertures to connect the first member to the second member.

34. The golf club head of claim 25, wherein the base member has a perimeter member extending around a perimeter of the base member and a cavity positioned within the base member, wherein the perimeter member extends around an entire periphery of the cavity and defines the cavity, and wherein the first apertures are positioned in the perimeter member around the entire periphery of the cavity.

35. The golf club head of claim 25, wherein the base member has a perimeter member extending around a perimeter of the base member and a cavity positioned within the base member, wherein the perimeter member defines the cavity.

36. The golf club head of claim 35, wherein the cavity comprises a hole completely through the base member, and wherein the perimeter member extends around an entire periphery of the cavity.

37. The golf club head of claim 25, wherein base member of the first member has a thickness measured in a front-to-rear direction that decreases from a bottom toward a top of the first member, and wherein the receiving slot has a width measured in the front-to-rear direction that decreases from the bottom surface toward a top surface of the second member.

38. A golf club comprising the golf club head of claim 25 and the shaft connected to the arm, wherein a hosel is connected to the arm of the first member and the shaft is connected at the hosel.

* * * * *